US006725784B2

(12) United States Patent
Crinion

(10) Patent No.: US 6,725,784 B2
(45) Date of Patent: Apr. 27, 2004

(54) MULTIPLE WORK STATION TABLE

(75) Inventor: Jonathan Crinion, Toronto (CA)

(73) Assignee: Incrion Limited-Asset "A" Design Division, Limassol (CY)

( * ) Notice: Subject to any disclaimer, the term of this patent is extended or adjusted under 35 U.S.C. 154(b) by 0 days.

(21) Appl. No.: 09/981,362

(22) Filed: Oct. 17, 2001

(65) Prior Publication Data

US 2003/0070595 A1 Apr. 17, 2003

(51) Int. Cl.[7] ..... A47B 57/00
(52) U.S. Cl. ..... 108/64; 108/50.01; 108/50.02
(58) Field of Search ..... 108/64, 65, 50.01, 108/50.02; 312/223.6, 195, 194, 265.2, 223.3

(56) References Cited

U.S. PATENT DOCUMENTS 4,679,510 A * 7/1987 Veyhl et al.
4,838,177 A * 6/1989 Vander Park
5,078,055 A * 1/1992 Bellini et al.
5,186,425 A * 2/1993 Keusch et al.
5,237,935 A * 8/1993 Newhouse et al.
5,277,132 A * 1/1994 Korb
5,522,324 A * 6/1996 van Gelder et al.
5,546,873 A * 8/1996 Conner et al.
5,638,759 A * 6/1997 Klugkist
6,003,447 A * 12/1999 Cox et al.
6,152,048 A * 11/2000 Vander Park
6,202,567 B1 * 3/2001 Funk et al.
6,267,064 B1 * 7/2001 Ostertag et al.
6,283,043 B1 * 9/2001 Stern et al.
6,336,414 B1 * 1/2002 Stewart et al.
6,415,723 B1 * 7/2002 Kopish et al.
6,427,608 B1 * 8/2002 Crinion

FOREIGN PATENT DOCUMENTS

GB 2180149 A * 3/1987

* cited by examiner

*Primary Examiner*—Jose V. Chen

(57) ABSTRACT

A work station system provides an interrupted expanse either side of the of the system allowing the free movement of workers therealong. Basically a worker cab be seated and move a chair along the system without interference with legs. Two longitudinal beams span the length of the system and cooperate with the end supports to form a box-like structure. The beam can be braced intermediate the length by bracing members mechanically fastened thereto, These components cooperate to form a base to which work surfaces are secured. Power and communication calling is provided in the center passage between the beams. A clear span in excess of four meters may be provided between the end supports.

15 Claims, 13 Drawing Sheets

MULTIPLE WORK STATION TABLE

FIELD OF THE INVENTION

The present invention relates to a support system for a series of work stations.

BACKGROUND OF THE INVENTION

The office environment continues to change and there is a need for office furniture systems which can accommodate different working environments. In some work environments such as call centers, there is a need for multiple work stations which are relatively private and are designed such that the worker has little interaction with adjacent workers. Such systems require convenient power for equipment, high load capability for supporting various equipment, as well as convenient telecommunication connections.

In other applications, the work stations may be used in association with a group environment where the office furniture should allow for effective interaction of the workers. Individual work environments should be easily changed and modified to address different users' needs as well as different requirements over the life of the product. The furniture should be capable of adjusting to unique environments such as brokers and stock traders where multiple computer screens are often used.

There have been a number of office furniture systems which address some of these needs. Panel based office systems uses office panels to subdivide the space and to cooperate with office furniture which utilizes the office panels. The office space is typically divided into office cells and these cells are normally open on at least one side and do not extend from floor to ceiling. Other office systems have been table based where each table forms the rain element for defining a work station and each table includes its own separate support system.

These systems are certainly acceptable for many work environments, however, they are primarily developed around a structure for forming a single work station which is then interconnected or associated with similar components for defining subsequent work stations. This allows incremental expandability, however, it is not appropriate for all work environments.

There are many business environments where a series of work stations are desirable. In this case, the table can be used to define side by side work stations on one side or both sides of the table. The individuals using the work stations may have different physical needs of the work station and the work space can be adjusted to meet these requirements. At a different point in time, the needs of the work space may change and the table can be converted to essentially a large table about which a number of works function in a group type manner. Interaction between workers is encouraged by the system while still providing power and computer connection to meet the current communication needs. In this way, the table system is adaptable to meet the needs of different work environments.

There are many applications where it is desirable to have a number of work stations in a relatively confined area. For example, this would be appropriate for a series of individual work stations all addressing a similar type function or where group interaction is promoted.

The present invention seeks to overcome a number of the disadvantages associated with existing office furniture systems while providing a flexible cost effective system which can respond and preferably expand to meet changing needs,

SUMMARY OF THE INVENTION

A convertible desk according to the present invention comprises two pairs of support legs at opposite ends of said desk connected by two spaced parallel beams connected to the pair of support legs, a plurality of bracing members connecting the beams at positions intermediate the length of the desk, at least two work surfaces either side of the desk sized to accommodate at least two work stations to each side of the desk.

According to an aspect of the invention the convertible desk comprises at least three work stations to each side of the desk.

According to a further aspect of the invention the convertible desk comprises at least one work station wherein said parallel beams are inwardly placed relative to said legs by at least one foot.

In yet a further aspect of the invention the convertible desk comprises at least four work stations and wherein the beams are extruded and have a series of fastening slots extending the length thereof.

In a different aspect of the invention the convertible desk comprises at least four work stations on each side thereof and fastening slots are provided on the beams and are used to secure outwardly extending brackets which support said work surfaces of the work stations.

The system of the present invention provides a long support structure to which work surfaces can be secured such that the exterior edge of the work surfaces and a portion therebelow is free of obstruction. This allows free movement of seated workers along the support structure without interference from support legs. Basically the portion of the system outwardly of the beams and intermediate the length of the beams is free of downwardly extending support structures.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
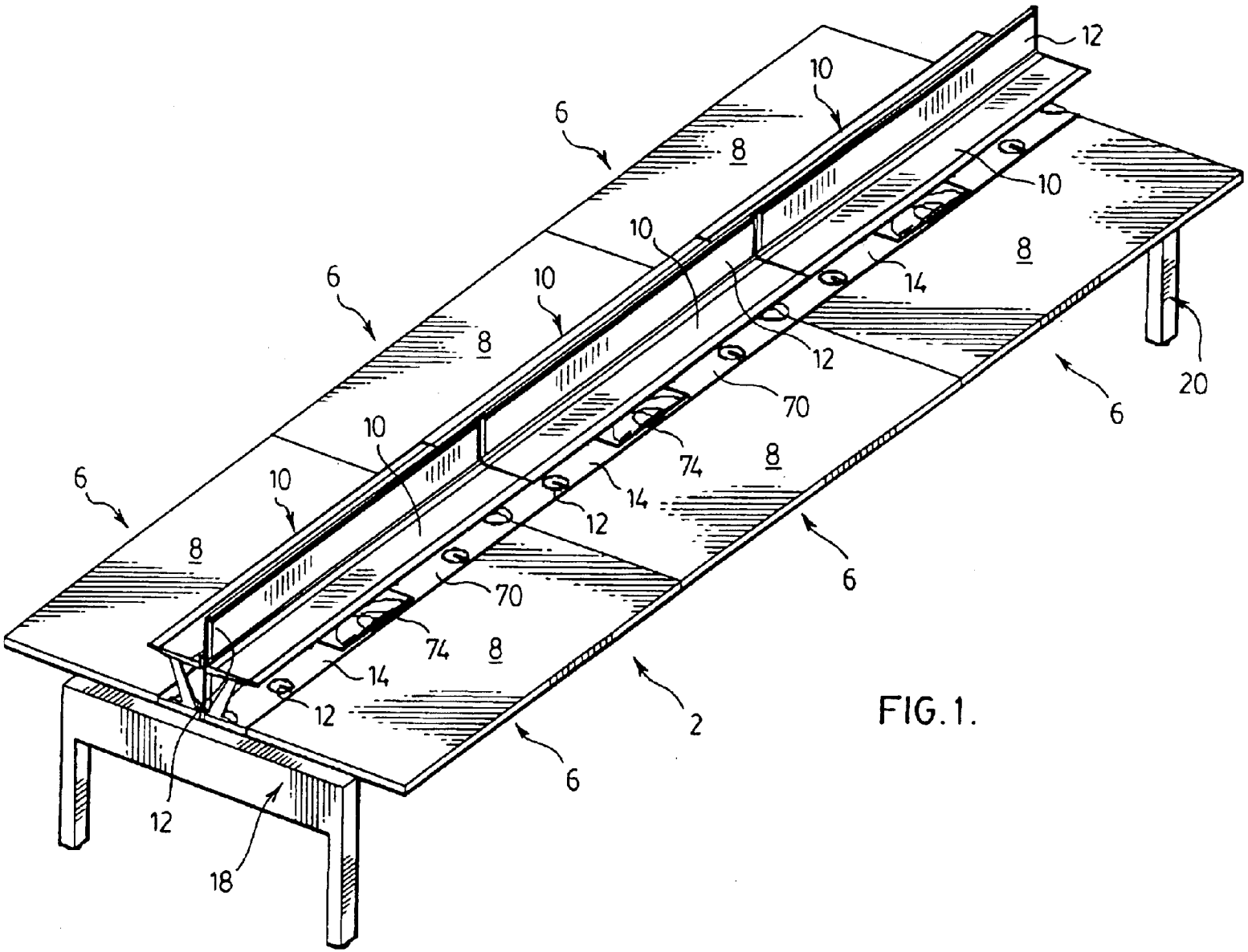
FIG. 1 is a perspective view of the work surface system showing a series of work surfaces.

The work surface system 2 of FIG. 1 has six different work stations 6. These work stations are collectively supported by the end supports 18 and 20. Each end support includes two legs, namely legs 18A and 18B and legs 20A and 20B. Thus the six work stations are commonly supported by four legs positioned at opposite ends of the system. The area beneath the work stations is essentially clear of legs or other supports and allows convenient user movement along the length of the work surface system. Each work station 6 includes a large flat desk surface 8 which in this case is approximately one meter by two meters. A further surface is defined by the fill in panels 70 located at an interior edge of the work surfaces 8.

Generally centered on the ends 18 and 20 is a freestanding privacy panel 8 which preferably is supported between opposed raised shelves 10. Each raised shelf 10 can be used for supporting books or manuals, monitor screens or other equipment. These shelves are optional and are not necessary for all applications. Connection to the electrical power and communication outlets is provided through the port covers 72 or the large access ports 74. Each work station 6 preferably has such access points and additional access points can be provided as required.

The work stations 6 are quite large and the overall length of the work surface system is approximately 6 meters. Each work station is designed to support at least 200 pounds. It can also be seen in FIG. 1 that the work surfaces 8 extend beyond the leg structures 18 and 20 and the legs are located within the endwork stations. In this way, work surface systems may be abutted end to end with a similar work surface system.

Figure 2:
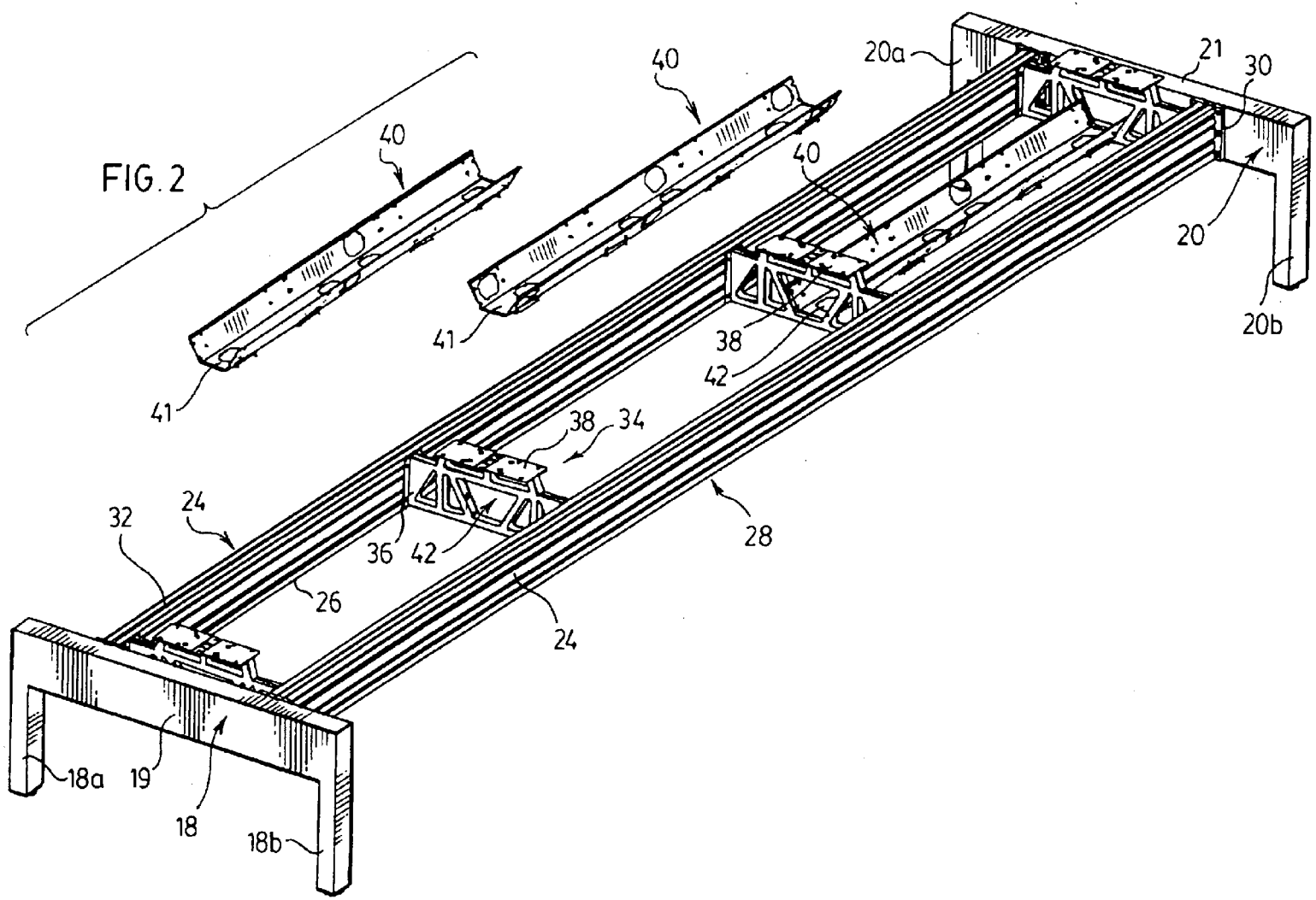
FIG. 2 is a partial exploded perspective view of the support and communication components of the work surface system.

FIG. 2 shows the support arrangement used to provide the extended span between the end support 18 and 20. End support 18 includes a horizontal beam type member 19 connecting legs 18A and 18B and mechanically fastened to the extruded beams 24. Similarly, legs 20A and 20B are connected by beam 21. The extruded beams 24 (see FIGS. 8 and 9) include four inside fastening slots 26 and four outside fastening slots 28 which are vertically spaced. These fastening slots are used to secure equipment and support brackets to the beams. Each of the beams also includes a top fastening slot 32 and a bottom fastening slot 29. Brace members 34 extend between the beams and are mechanically fastened thereto. The brace members 34 have flanged ends 36 and mechanical fasteners serve to provide the connection between the flanges and beams using the inside fastening slots. These brace members 34 are positioned to brace against twist of the beans 24 intermediate the end supports 18 and 20. Each of the braces includes top fastening plates 38 which are used to secure support brackets and/or fill in panels as will be more fully described. The brace members 34 include a trapezoidal shaped cavity 42 which is sized to receive and support the longitudinally extending cable troughs 40. As shown in FIG. 2, brace members 34 are located at either end of the beams and at two intermediate positions in the length of the beams. The cable troughs 40 are mechanically fastened to the brace members 34 or any other suitable fastening arrangement can be used. These brace members provide beam stiffening and also serve as a work surface support and/or bracket support. Preferably one brace member 34 is provided at the edge of each work station.

Figure 3:
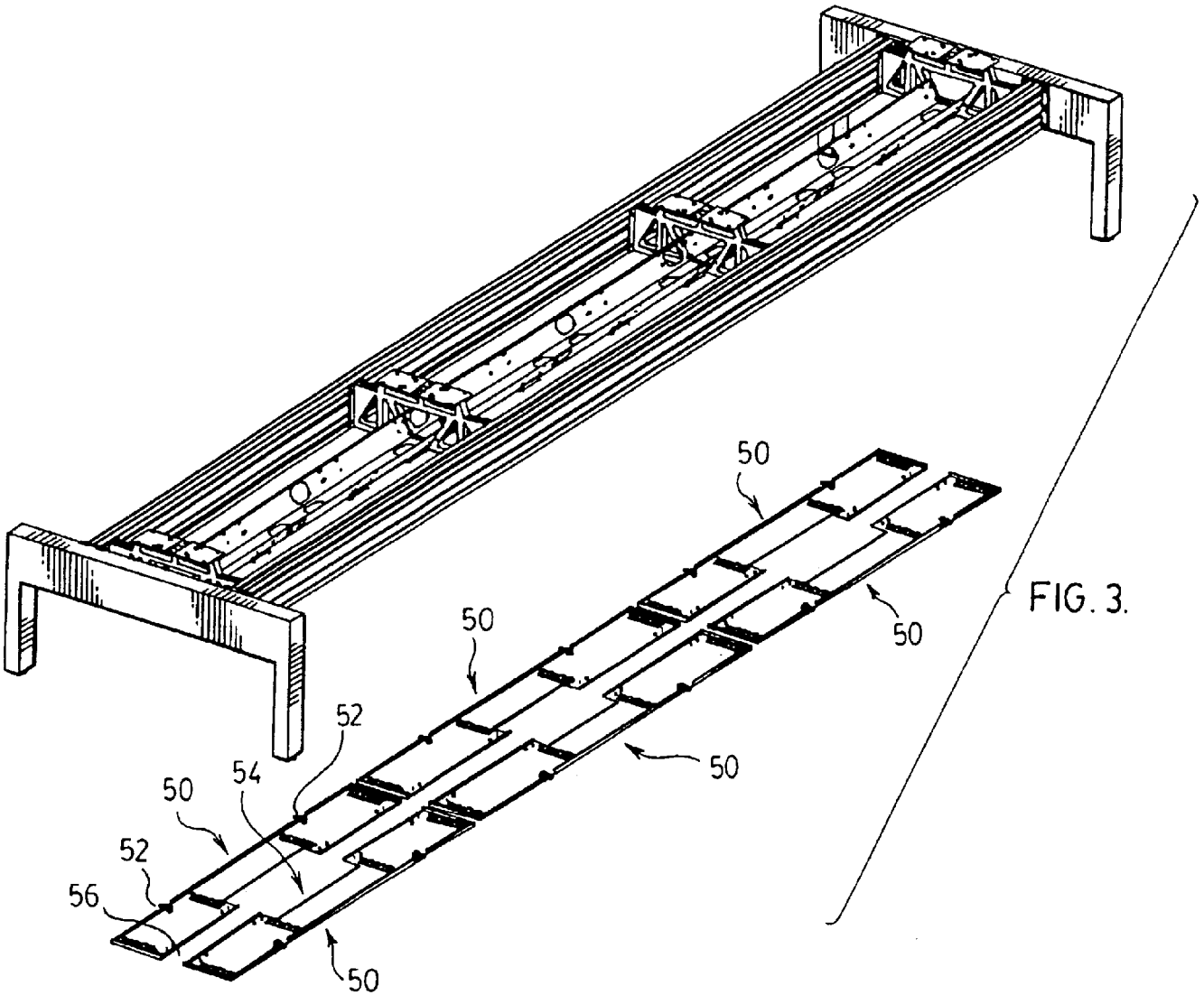
FIG. 3 is a partial exploded perspective view showing bottom covers about to be applied to the work surface system.

The support arrangement as shown in FIG. 3 has all of the cable race ways inserted in the brace members 34 and bottom cover panels 50 are about to be secured. These bottom panels include extending fasteners 52 for engaging one of the slots of the beams 24 and also include a recess 54 to allow cabling to gain access to the troughs 40 through knock out ports. The gap 56 between the bottom covers 50 is covered by the bottom of the cable troughs 40.

Figure 4:
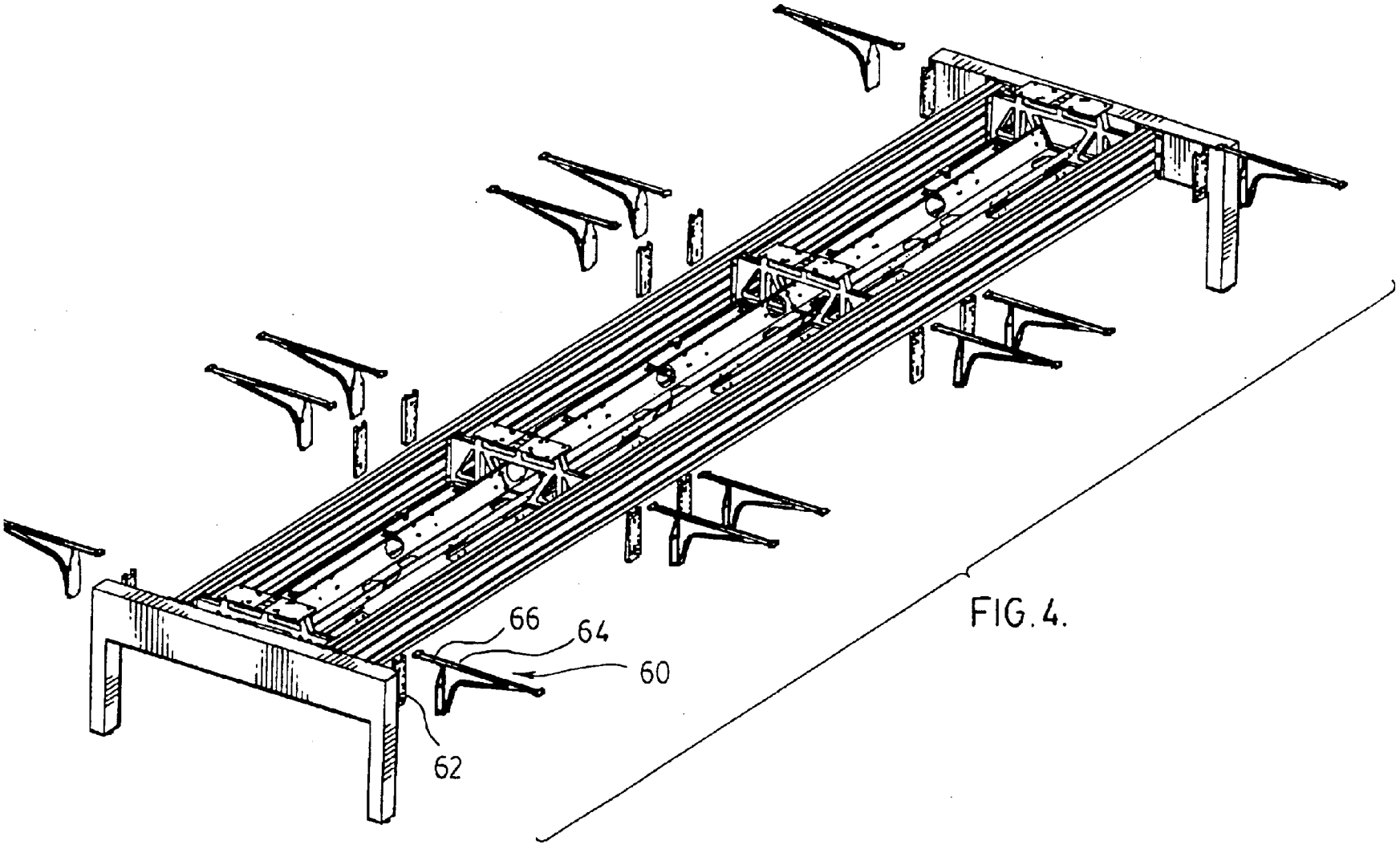
FIG. 4 is a perspective view showing the attachment of work surface support brackets to the beam.
Figure 5:
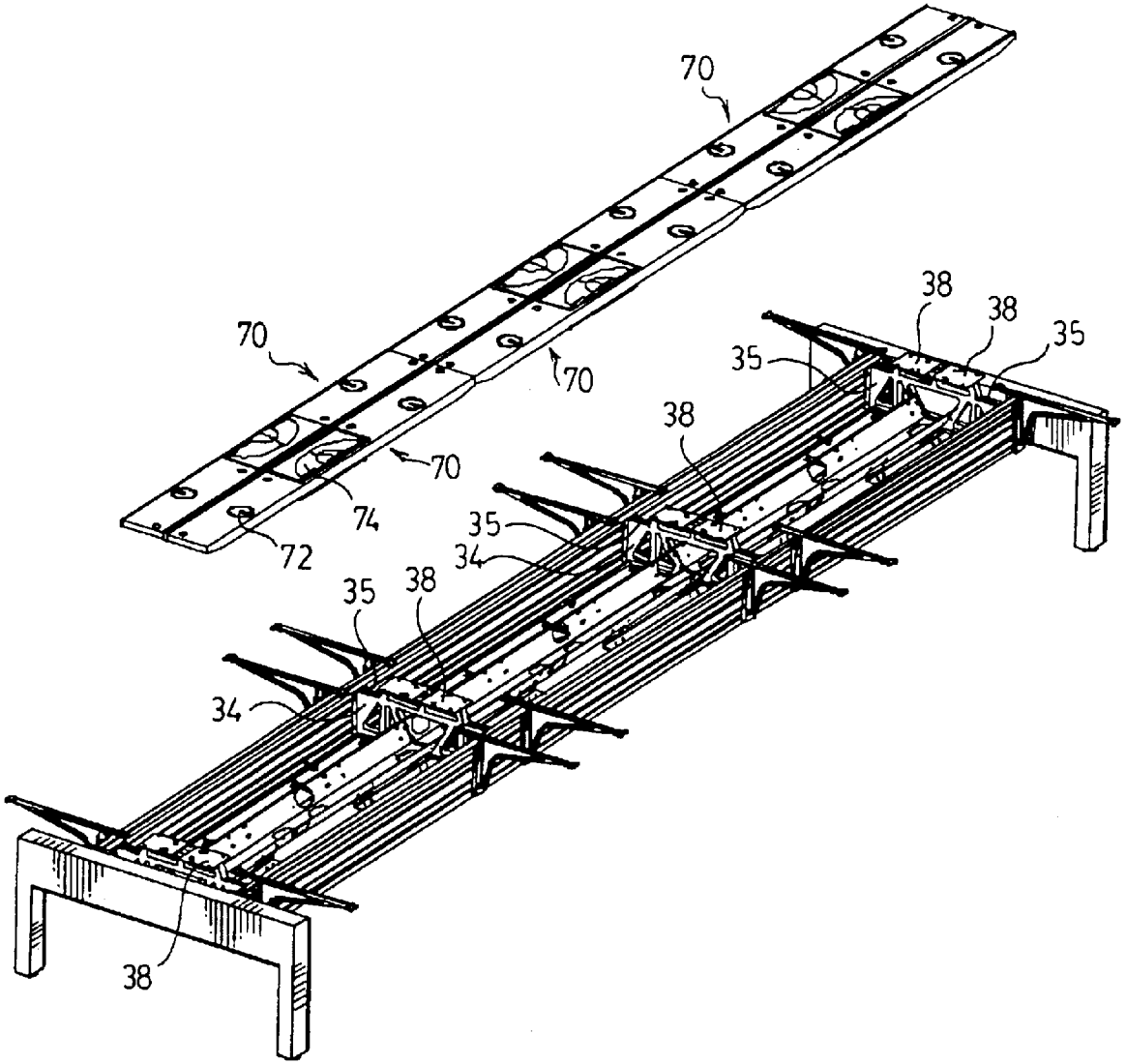
FIG. 5 is a perspective view showing the securement of interior surfaces of the system.

FIG. 4 shows the securement of work surface brackets 60 to the beams 24. These brackets have mechanical fasteners which engage the securing slots of the beams. For convenience, a spacer bracket 62 is initially secured to the beams and the brackets are secured to the spacer. These brackets 60 can be secured at different heights to allow the work surface of that particular work station to be at a height appropriate for the user. The use of the spacer brackets 62 accommodate more height adjustment positions for the bracket 60. The various work surface brackets 60 are secured to the system at the appropriate heights to form the structures generally shown in FIG. 5. As can be seen, the brackets 60 are positioned to extend above the beams 24 and include an inwardly projecting flange portion for engaging a rear surface of the work surface. The brackets can be positioned at any position along the beam to accommodate different work surface sizes FIG. 5 shows the general securement of the fill in panels 70 adjacent the center line of the work station system. Each of the panels 70 include a series of small ports 72 to allow various communication wiring or power to pass therethrough and also includes a center pull up panel 74 to provide more power access to terminal outlets accessible through the port. Thus the work station system can have a series of secured terminals or outlets that are accessed by upward movement of the large access port 74.

Figure 6:
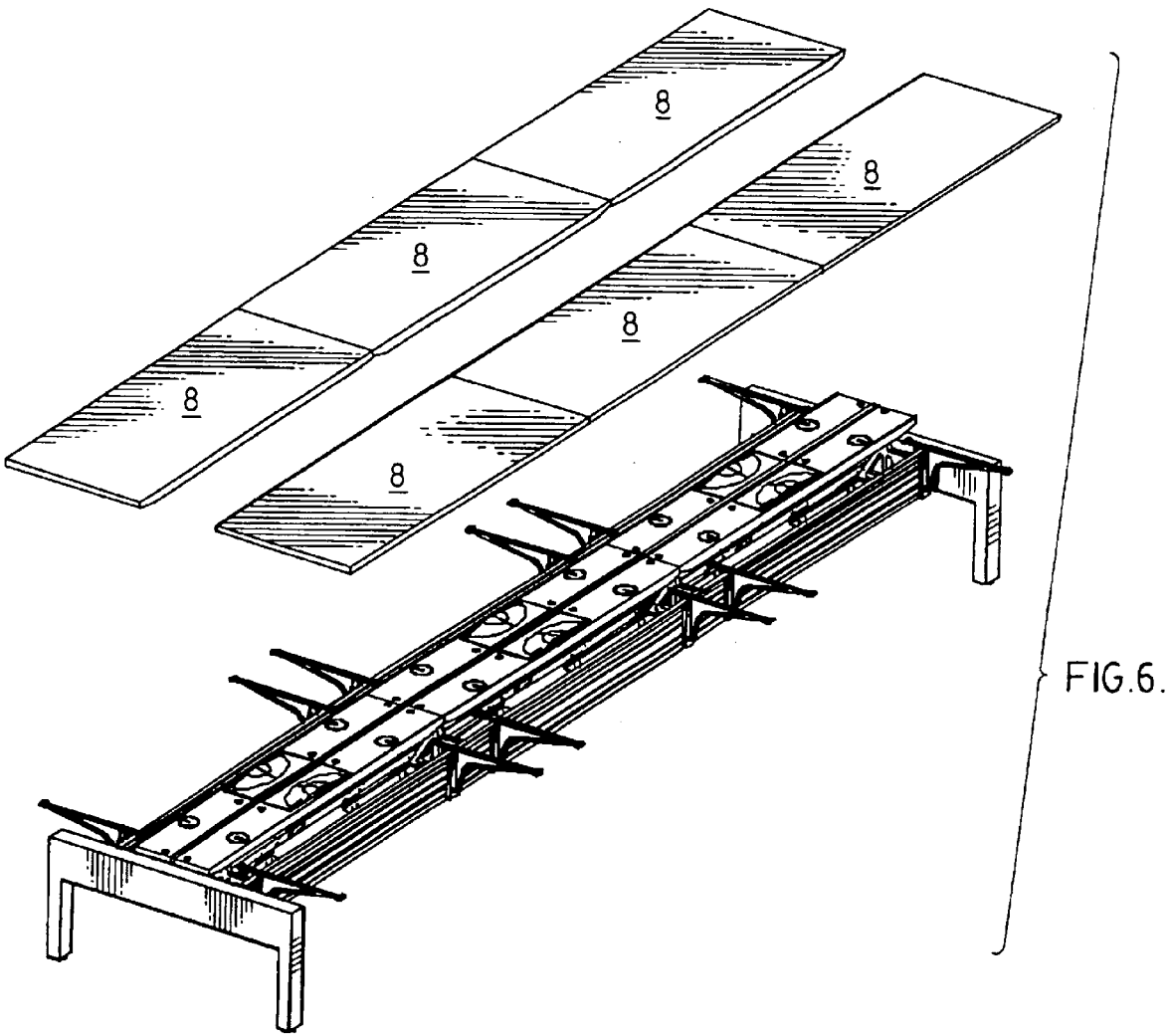
FIG. 6 is a perspective view showing additional large individual work surfaces about to be secured.

The fill in panels 70 are secured to the work station system in FIG. 6 and the large work surfaces 8 are about to be secured to the work surface brackets 60, Any suitable means for securing of the work surface 8 to these brackets can be used. The brackets can be secured to the brackets at different positions to support the work surface at different heights.

Figure 7:
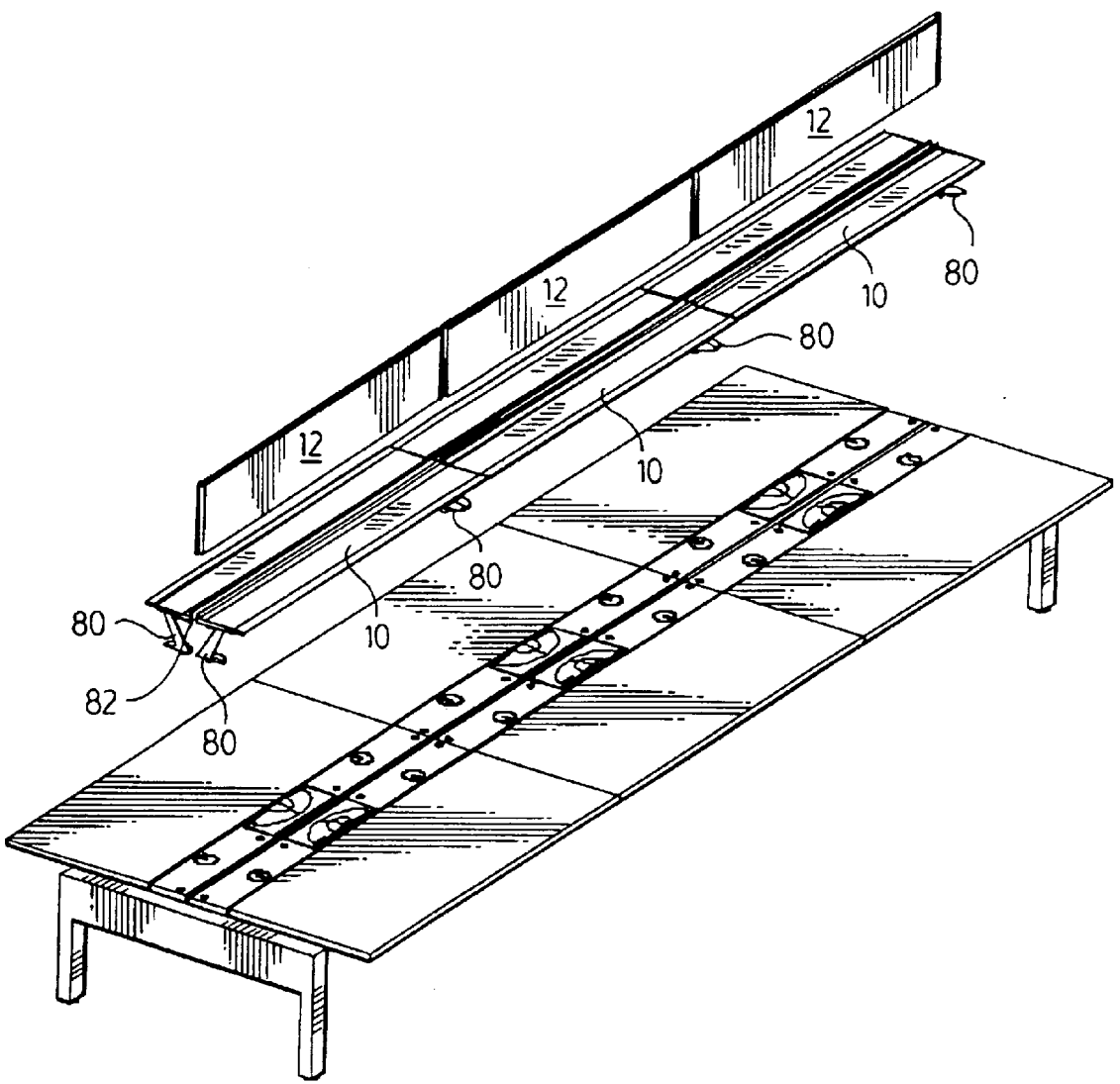
FIG. 7 is a partial exploded perspective view showing the securement of additional shelves and privacy screens to the system.

The work surfaces 8 have been secured in the system of FIG. 7 and additional components are about to be secured above the work surfaces. In particular brackets 80 are used to mechanically fasten the shelves 10 above the height of the work surface 8. The shelves are typically used in a back to back manner and define a screen receiving gap 82 between the back edges of the shelves 10. The privacy screen 8 can be inserted in the gap 82 to provide user privacy as generally shown in FIG. 1. The work surface system preferably includes a securing rail or slot extending the length of the system to which privacy screens 8 can be secured. In this case the privacy screens include a base portion which cooperates with this rail or slot to allow the panel to be secured at any point along the center line of the system.

The work station system can also include privacy panels which are perpendicular to the beams 24. Any suitable arrangement for securing these to the structure can be used.

The work station system shown in FIG. 1 is of a robust construction and provides an extended span between legs. This is accomplished by the use of twin extruded beams which are mechanically fastened to the strong end supports 18 and 20 with bracing members provided between the beams at various intermediate points. The embodiment shown has six work stations, however, the greater spans can be used if desired. The beams are preferably made of an extruded aluminum.

In contrast to many prior art systems, the individual work surfaces are merely added to the system and are not used as a primary support structure. The primary support structure in this case is the legs 18 and 20 and the beams 24 interconnected by the bracing members 38. The system in providing an extended span also provides individual work space adjustment to accommodate the individual characteristics of the users. It has been found that this type of structure is particularly useful for group environments where one user can basically freely move along the one edge of the series of work stations without interruption by legs, etc. and it is also useful in call trading room environments where individual connected work cells are preferred. The raised cantilevered shelves 8 provide additional work surfaces that can be customized for the particular application. Excellent power access in communication connection is achieved and access wiring can be stored in the cable troughs 40.

Figure 8:
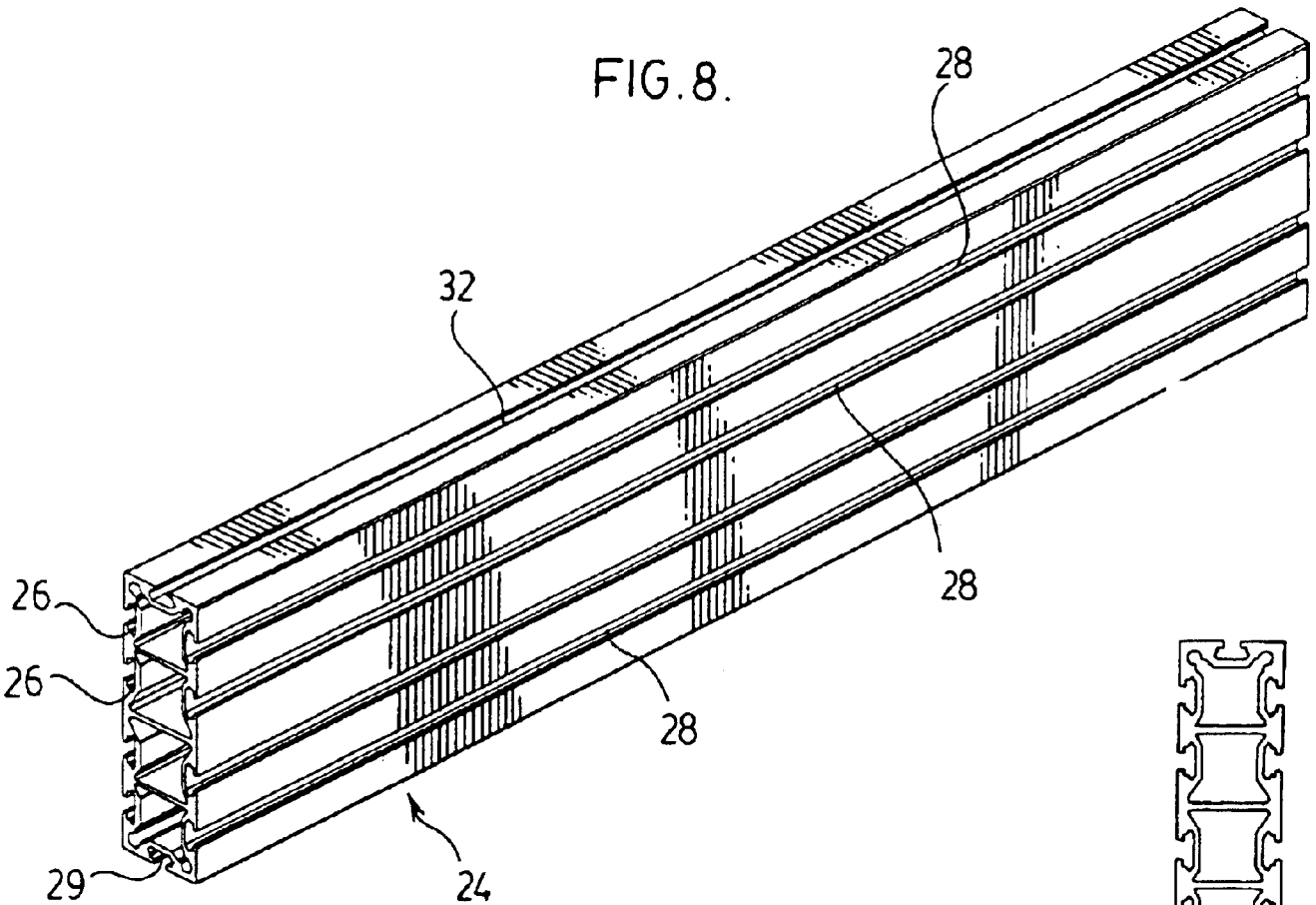
FIG. 8 is a perspective view of one of the support beams.
Figure 9:
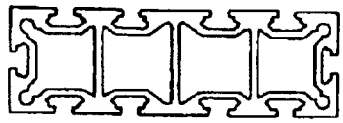
FIG. 9 is a cross section of one of the support beams.

The extruded beam 24 shown in FIGS. 8 and 9 has a host of securing slots 26, 25, 29 and 32 exposed on the periphery of the beam which provide stiffening as well as convenient fastening points along the length of the beam. This beam design allows the system to be adaptable in that for some applications very large work surfaces for example, one meter by 2 meters are spaced along the length of the beam and supported by the beam. A similar size work surface can be secured to the opposite side of the system. In other circumstances it may be desirable to have one continuous large work surface secured to one side of the system with different size work surfaces secured on the opposite side of the system. The use of the beam and the slots along the length of the beam allow for essentially infinite adjustment along the length of the beam. This extruded beam with the various securing slots also allows for placement of braces where desired joining one beam to the other beam. With this system the space beneath the work surface forward of the beams is typically in the order of half a meter to three quarters of a meter. Any intermediate support provided between the end supports can be interior to the beam such that the work surface edge along one side of the system is basically uninterrupted and a person can slide up and down the length of the system to various work surfaces therealong. There are no legs located in this space in most cases for example, in a system up to six meters, no intermediate leg support is necessary. If desired a center leg could be attached to one of the bracing members or attached to the beams intermediate the width of the beams. In this way, the uninterrupted working edge of the system to either side thereof is clear of legs between the end supports. Basically the beams are in a clear span condition and this clear span will be at least four meters in length. A clear span of up to eight meters is possible merely by sizing of the beams 24 and providing appropriate bracing intermediate the length of the beams. The end supports and the beams as well as the bracing members provide a reinforced box structure to which the work surfaces are secured. The work surfaces are adjustable in height where this feature is desirable or can be of a common height. As the needs of the system change, the work surfaces may be replaced or added to while maintaining the core support of the system. As can be appreciated the size of the work surfaces can also be easily changed to suit individual needs. The use of the center power and communication feature in combination with elevated surfaces generally at the center line of the system allows great flexibility to meet the needs of different work applications. For example, in a brokerage or trading application multiple computer screens can be secured generally adjacent the center of the system and the work surfaces can be relatively large promoting communication with other traders. In other applications it may be desirable to have a large almost common work surface provided to one side of the system. In this case, the work surfaces are secured at the same height thus forming a continuing surface. This promotes interaction between the workers and is more like a large wide conference table with power and communication capabilities.

It is desirable to use the system for defining at least four work stations to one side of the system and four work stations to the other side. The width of each work station from the longitudinal center line of the system outwardly to the free edge is at least 0.75 meters and preferably one meter. Each work station is preferably at least 1.6 meters in running length of the system and preferably up to 2 meters. A more generous work space is based on a 6 meter length with three work surfaces, each 2 meters in length on each side of the system.

Preferably the beams 24 are made of extruded aluminum and as shown in FIG. 8 have a series of compartments extending the length of the beam. A plug type fastener can be inserted in the ends of the beam to provide strong mechanical connection and fastening can still be made in association with the various securing slots. The beams are preferably much deeper than the width thereof to provide good strength with respect to bending particularly when the beam is interconnected to the adjacent beam by means of the various brace members. The precise size of the beams and the relation of width to depth will vary with the particular application. This calculation will be based on the strong box-like configuration of the combination of the beams, braces and end supports. The system is designed with suitable safety margins and includes support for at least 200 pounds of computer equipment and books and manuals etc. on the system at each work station and also is designed to support a persons weight sitting on the table at the edge of the work surface.

Figure 10:
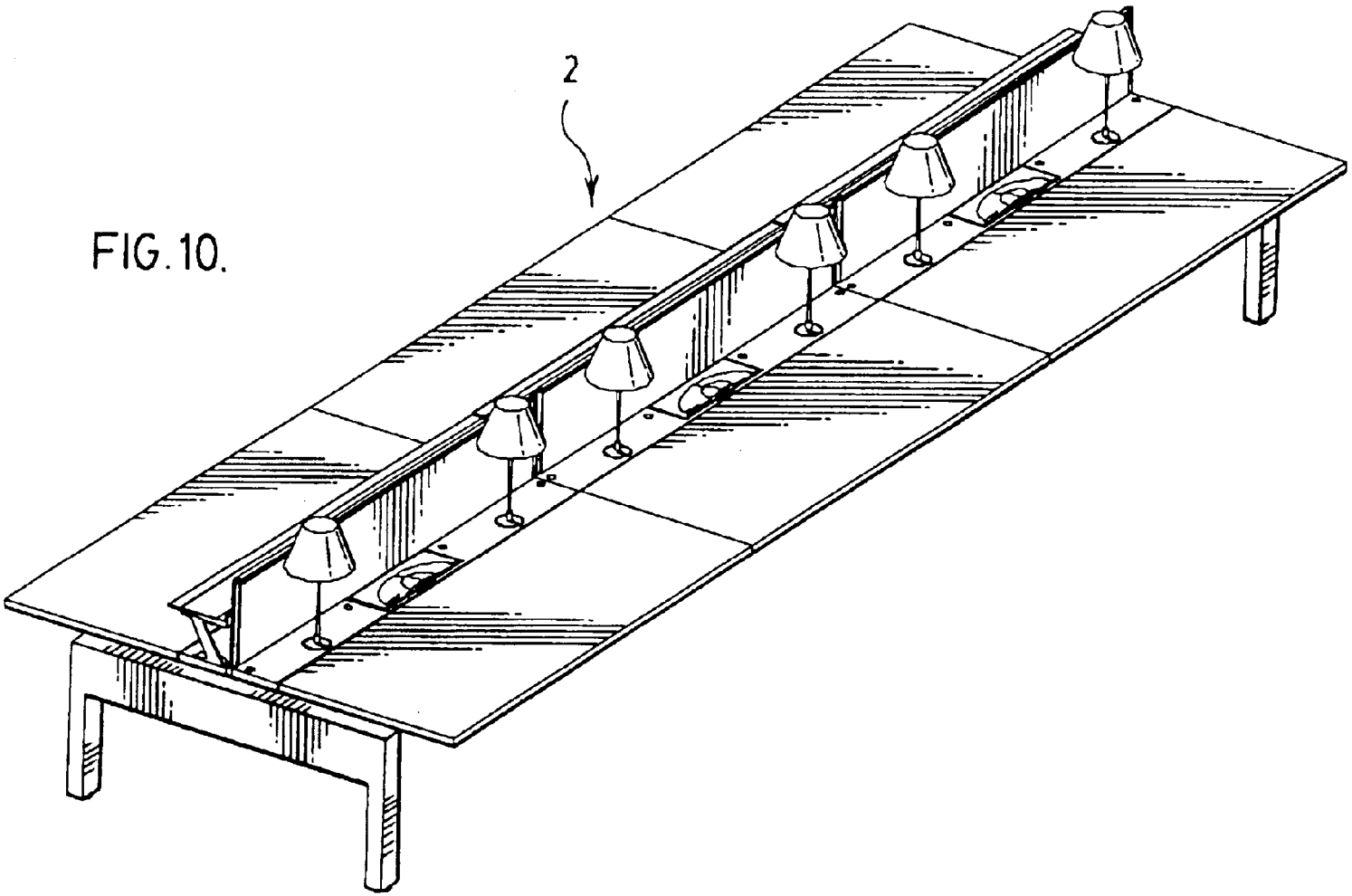
FIG. 10 is a perspective view of an alternate layout of the work surface system.

The perspective view of FIG. 10 shows the work surface system 2 arranged such that one side of the work surface system has three work cells with a raised shelf adjacent the center line of the system and the opposite side of the work surface system has three work surfaces all at the same height and with a different layout at the center of the system. As can be appreciated, the work surface system is adaptable to different configurations to meet the needs of the work environment and in particular, one side of the system need not mirror the other side of the system.

Figure 11:
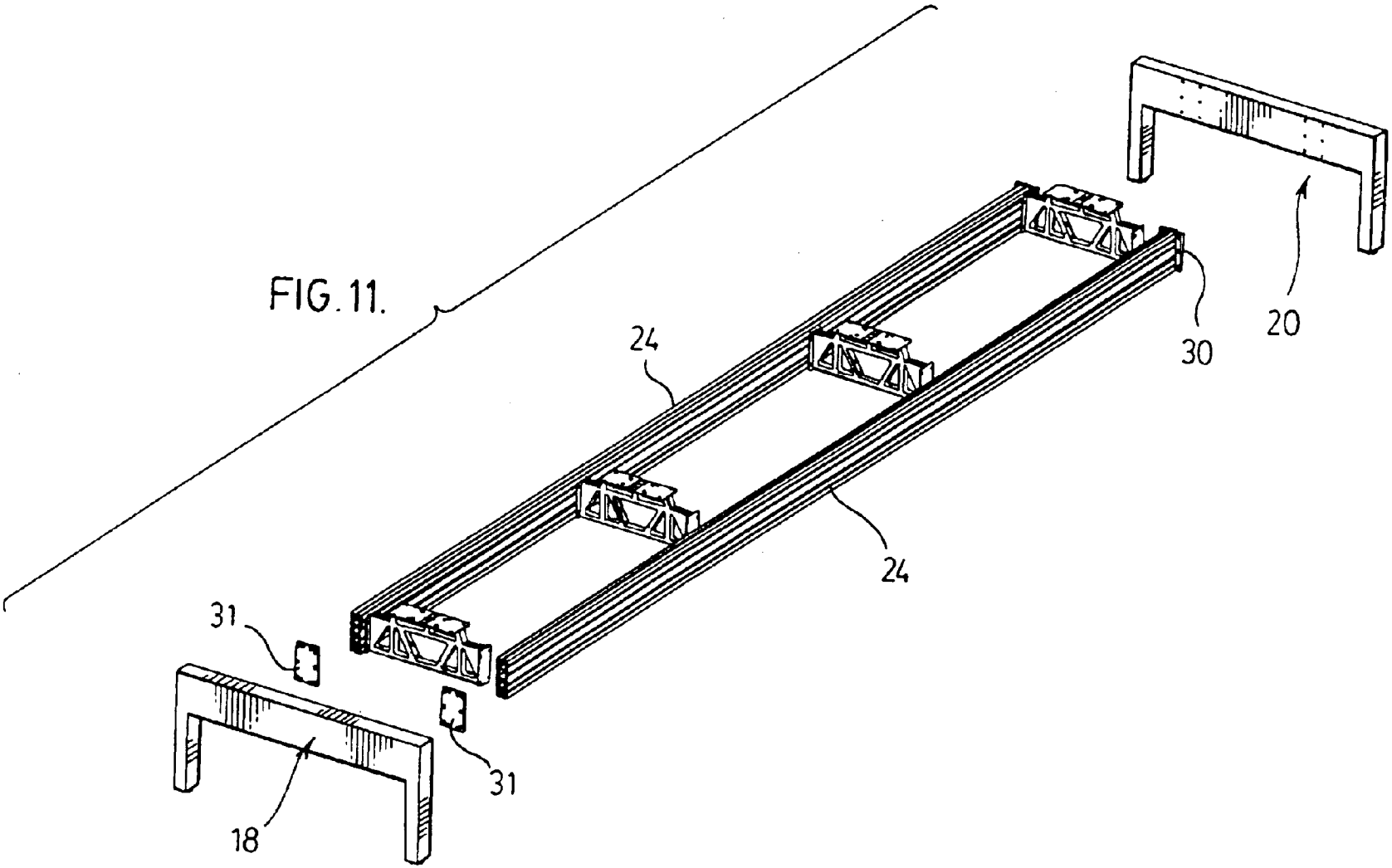
FIG. 11 is an exploded perspective view of the primary support components of the system.

FIG. 11 shows additional details of the securement of the end legs 18 and 20 to the extruded beams 24. End plates 31 can be fastened to the extruded beams 24 using any of the securing slots of the beam which are exposed at the end of the beam as more clearly shown in FIGS. 8 and 9. The end plates 31 are oversized relative to the beams 24 and thus provide fastening flanges 30. These fastening flanges 30 are used to mechanically fasten the extruded beams to the legs 18 and 20. Thus the extruded beam not only provides securing slots to the sides thereof and the top and bottom thereof, but also provides an end section having a series of securing ports for allowing connection of the end plates 31. As can be appreciated, these end flanges provide a convenient way to secure the beams to the legs, however, a direct mechanical securement through the legs 18 and 20 directly to the beams is also possible. The system as shown in FIG. 11 allows the end surfaces of the legs 18 and 20 to be clear of mechanical fasteners.

Figure 12:
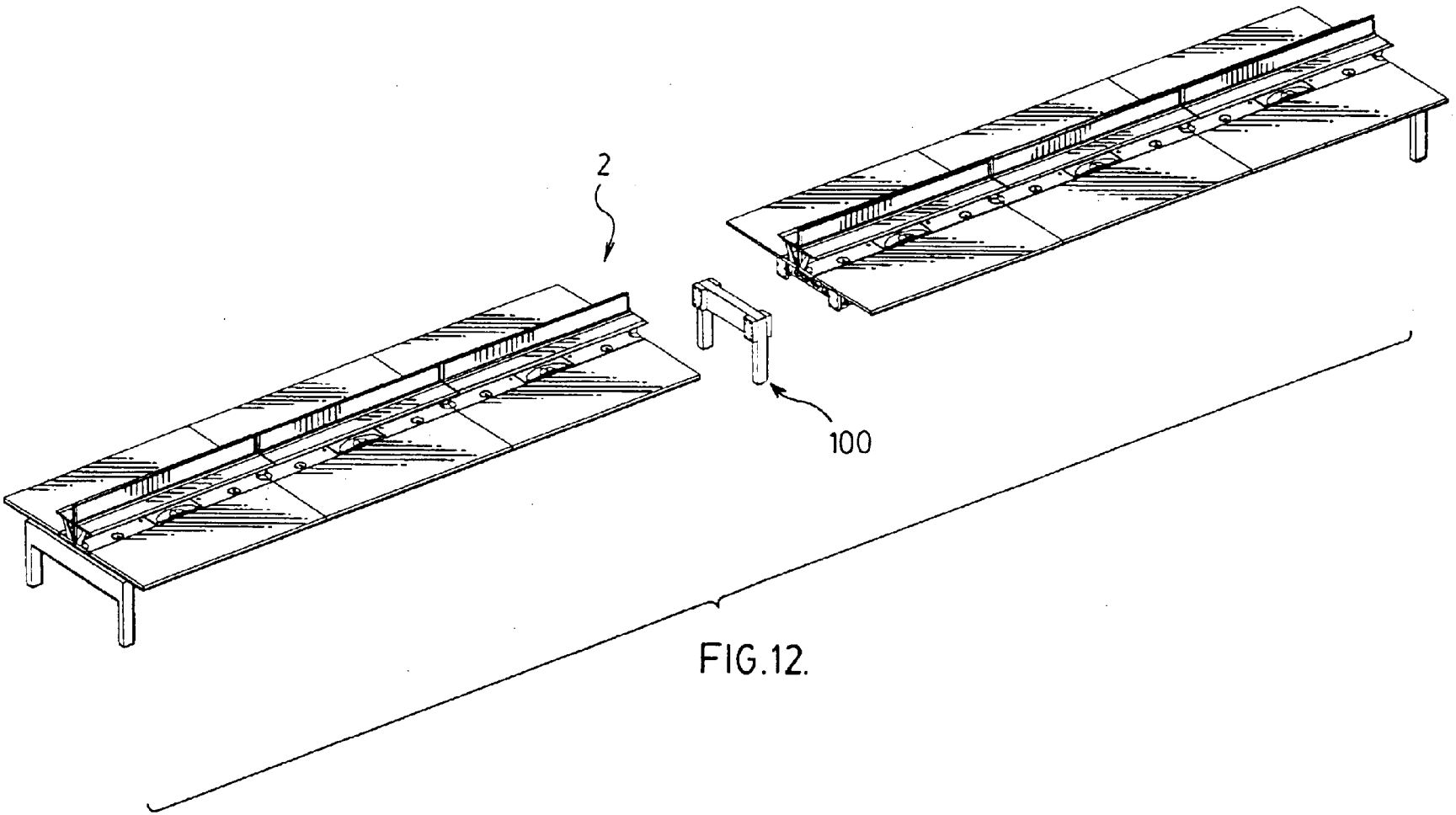
FIG. 12 is an exploded perspective view showing an intermediary support used to extend the work surface system.
Figure 13:
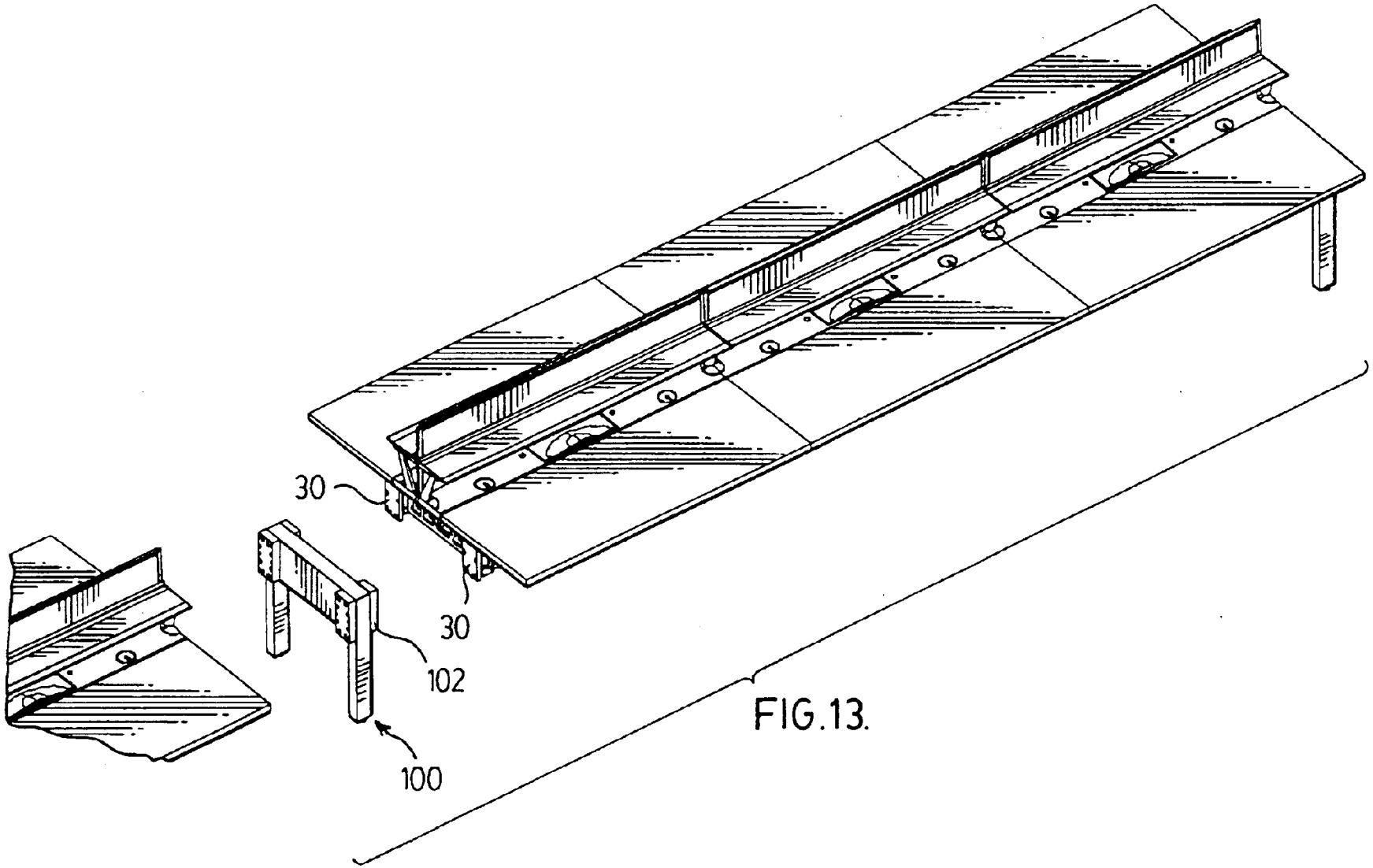
FIG. 13 is a partial perspective view showing details of the intermediary support.

The exploded perspective view of FIG. 12 shows the use of an intermediate support 100 which is the approximate width between the two beams 24. The leg support 100 allows the work surface system to be extended in this case from six meters to 12 meters by securing of an intermediate leg 100 at the mid point of the system. The intermediate leg 100 serves to replace the two end legs 18 and 20 which would otherwise be present. Details of the intermediate leg are shown in FIG. 13. The intermediate leg 100 has securing faces 102 either side of the leg which acts as a spacer and cooperate with the fastening flanges 30 of each of the extruded beams. The intermediate leg 100 will be positioned at the mid point and is of twice the thickness of a normal leg to allow connection to each of the extruded beams. Mechanical fasteners can pass through the end plates 30 and engage the members 102 and thus secure the intermediate leg 100 at the midpoint of the system. The intermediate leg 100 preferably does not extend beyond the width of the beams thereby providing a system where the work surface edges are basically uninterrupted. This is in contrast to an arrangement where two of the work surface systems are abutted in an end to end manner resulting in a partial interruption due to the center legs 18 and 20 at the mid point of the combined system. The use of the intermediate leg 100 avoids this problem and adds sufficient stability to the system even though the intermediate leg 100 does not extend beyond the beams.

Figure 14:
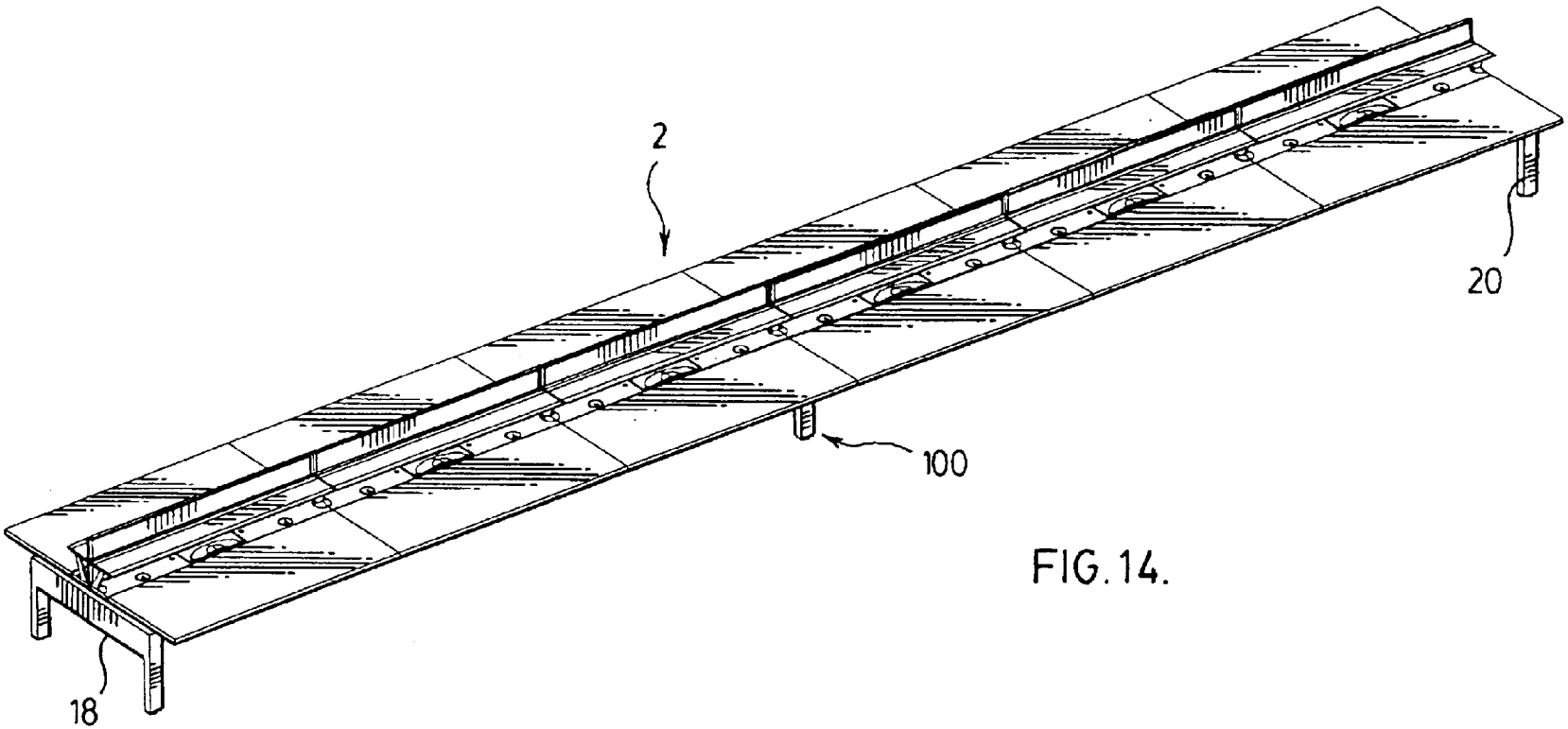
FIG. 14 is a perspective view of an extended work surface system.

The resulting combined system is shown in the perspective view of FIG. 14.

It has been found that the present system meets the various loading requirements set out by the industry with respect to maximum load capability as well as stability. It can be seen that the end supports are quite wide and the strong beams which are stiffened by the braces provided centrally in the system provide excellent transfer of the loads to the end support.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A convertible desk comprising two pairs of support legs at opposite ends of said desk connected by two spaced parallel beams connected to said pair of support legs, a plurality of bracing members connecting said beams at positions intermediate the length of said desk, at least two work surfaces at either side of said desk, said at least two work surfaces supported by said beams and sized to accommodate at least two work stations to each side of said desk; and wherein said beams are extruded and have a series of fastening slots extending the length thereof with each series of fastening slots including two longitudinally extending fastening slots forming part of a mechanical connection of said bracing members to said beams.

2. A convertible desk as claimed in claim 1 wherein each beam supports at least three work surfaces to define at least three work stations to each side of said desk.

3. A convertible desk as claimed in claim 1 wherein said parallel beams are inwardly placed relative to said legs by at least one foot.

4. A convertible desk as claimed in claim 1 wherein said fastening slots of each beam cooperate and secure outwardly extending brackets which support said work surfaces.

5. A work surface system comprising at least 3 work stations on each side of a center line of said system, a support arrangement including two parallel beams extending between end legs located at opposite ends of said system, connecting means along said beams and securing said beams on to the other, each beam including securing points for attaching work surface brackets to said beams, work surfaces attached to said beams by said brackets, and wherein said work surfaces extend in a cantilevered manner beyond said beams to define an work surface edge which a worker can move along without interruption from leg supports between the ends of said system; each beam being of an extruded section and having a series of longitudinally extending securing slots on the exterior surface thereof; and wherein said connecting means are a series of structural brace members spaced on the length of said beams and mechanically secured to said securing slots of said beams.

6. A work surface system as claimed in claim 5 wherein each beam has at least 6 securing slots and each side of said beam includes at least two of said slots.

7. A work surface system as claimed in claim 5 wherein each beam has at least 8 securing slots and each side of said beam includes at least three of said slots.

8. A work surface system as claimed in claim 7 wherein said system is of a length of approximately six meters.

9. A work surface system as claimed in claim 7 of a length in excess of 6 meters with an intermediate leg of a width approximately equal to the space between said beams centrally secured to support paid beams intermediate the length of said work surface system.

10. A work surface system as claimed in claim 9 of a length in excess of 8 meters.

11. A work surface system as claimed in claim 9 of a length of approximately 12 meters.

12. A work surface system as claimed in claim 5 wherein said series of structural brace members include structural brace members at opposite ends of said beams and at least two structural brace members intermediate the length of said beams, said structural brace members cooperating with said beams to oppose twist of said beams.

13. A work surface system as claimed in claim 5 wherein said series of structural brace members include top securing slots extending between said beams and accessible between work surfaces.

14. A work surface system as claimed in claim 13 further including fill in panels supported by said structural brace members and positioned on a center line of said work surface system.

15. A work surface system as claimed in claim 5 where in said structural brace members include ports therethrough which receive and support cable troughs extending along said work surface system.

* * * * *